US005650772A

United States Patent [19]

Schmidt

[11] Patent Number: 5,650,772

[45] Date of Patent: Jul. 22, 1997

[54] DEVICE FOR INDICATING A FAULTY CONDITION OF AN ELECTRICAL APPARATUS, IN PARTICULAR OF A SURGE ARRESTER

[75] Inventor: Walter Schmidt, Bellikon, Switzerland

[73] Assignee: Asea Brown Boveri AG, Baden, Switzerland

[21] Appl. No.: 552,953

[22] Filed: Nov. 3, 1995

[30] Foreign Application Priority Data

Feb. 23, 1995 [DE] Germany ..... 195 06 307.4

[51] Int. Cl.[6] ..... G08B 21/00

[52] U.S. Cl. ..... 340/664; 340/662; 340/657; 340/659; 324/555; 324/133; 337/332

[58] Field of Search ..... 340/652, 657, 340/659, 662, 664; 324/555, 550, 133; 337/332

[56] References Cited

U.S. PATENT DOCUMENTS

| | | | |
|---|---|---|---|
| 2,677,817 | 5/1954 | Rorden et al. | 324/133 |
| 3,573,782 | 4/1971 | Williams | 340/664 |
| 4,734,823 | 3/1988 | Cunningham | 361/125 |
| 5,057,810 | 10/1991 | Raudabaugh | 337/30 |
| 5,341,271 | 8/1994 | Hutchinson | 361/123 |

FOREIGN PATENT DOCUMENTS

0564334A1 10/1993 European Pat. Off. .

*Primary Examiner*—Jeffery Hofsass
*Assistant Examiner*—Ashok Mannava
*Attorney, Agent, or Firm*—Burns, Doane, Swecker & Mathis, L.L.P.

[57] ABSTRACT

The indicating device (3) is used for signalling a faulty condition of an electrical apparatus, in particular of a surge arrester (1). It contains a sensor (resistor 10) which is located in an insulating material housing (6) and is intended for detecting a fault current flowing through the apparatus, as well as a two-piece metal housing (4) surrounding the insulating material housing (6). The sensor (10) and the insulating material housing (6) are part of a switching element (5). This switching element (5) causes the insulating material housing (6) to spring apart, by the formation of compressed gas, when the fault current occurs and displaces the two parts (shells 12, 13) of the metal housing (4), making the indicating element (16) visible and forming a DC connection which carries the fault current.

10 Claims, 2 Drawing Sheets

DEVICE FOR INDICATING A FAULTY CONDITION OF AN ELECTRICAL APPARATUS, IN PARTICULAR OF A SURGE ARRESTER

DESCRIPTION

1. Technical Field

The invention is based on a device for indicating a faulty condition of an electrical apparatus, in particular of a surge arrester, having a sensor for detecting a fault current flowing through the apparatus, a gas-tight insulating material housing which accommodates the sensor, and an indicating element. When a fault current occurs, the sensor causes the housing to be destroyed and makes the indicating element visible. An observer can identify the faulty condition of the apparatus without using any aids and can initiate its replacement in good time.

2. Prior Art

The invention makes reference to a prior art of indicating devices as is specified in EP 0 564 334 A1. An indicating device which is described in this prior art is used to monitor a surge arrester, which is used in a high- or medium-voltage network, for a faulty operating condition. This device has an insulating material housing with an easily frangible window. An electrical connection of the surge arrester is passed through the insulating material housing. That part of the electrical connection which is located in the housing interior is surrounded by a magnet core which is fitted with the secondary winding of a current transformer, which has the electrical connection as the primary winding. The secondary winding is connected to a non-reactive resistor which is embedded in an explosive charge arranged in the housing interior. When a fault current occurs, the non-reactive resistor, which is supplied with current continuously by the current transformer, is heated very severely. The resistor detonates the explosive charge, above a critical limit temperature. The window of the insulating material housing is at the same time broken open and a coloured ribbon, which is used as the indicating element, is ejected from the housing. After responding and signalling the faulty condition, the surge arrester and the indicating device are removed and replaced.

BRIEF DESCRIPTION OF THE INVENTION

The invention, as it is specified in the patent claims, is based on the object of specifying an indicating device of the type mentioned initially, which is distinguished by simple construction and which can be made ready for operation again after responding, in a cost-effective manner.

The indicating device according to the invention is distinguished by the fact that, in addition to a metal housing which can be used a number of times, it contains only one switching element, which is commercially available and is marketed in large quantities and whose residues, after the indicating device has responded, can easily be removed from the metal housing and replaced by a new switching element. By suitable dimensioning of a non-reactive resistor which is provided in the switching element, for example a fuse or a PTC thermistor, the operating conditions to be detected by the apparatus to be protected, such as current surges of, for example, 100 kA lasting for 4/10 μs, can act on the indicating device in a very simple manner without causing it to respond. The use of a spark gap, which is arranged in parallel with the non-reactive resistor, results in an arc being struck when the indicating device responds, which arc initiates, with a high level of reliability, the explosion of an explosive charge which is provided in the switching element. Fragments which are produced in this case are absorbed by the metal housing and the compressed gas which is produced can be dissipated from the metal housing in directions in which it cannot cause any consequential damage. The indicating element, which is fitted on the metal housing and is made visible when it responds, can be observed well from virtually every side.

BRIEF DESCRIPTION OF THE DRAWINGS

Preferred exemplary embodiments of the invention and the further advantages which can be achieved by them are explained in more detail in the following text with reference to drawings, in which.

METHOD OF IMPLEMENTATING OF THE INVENTION

Figure 1:
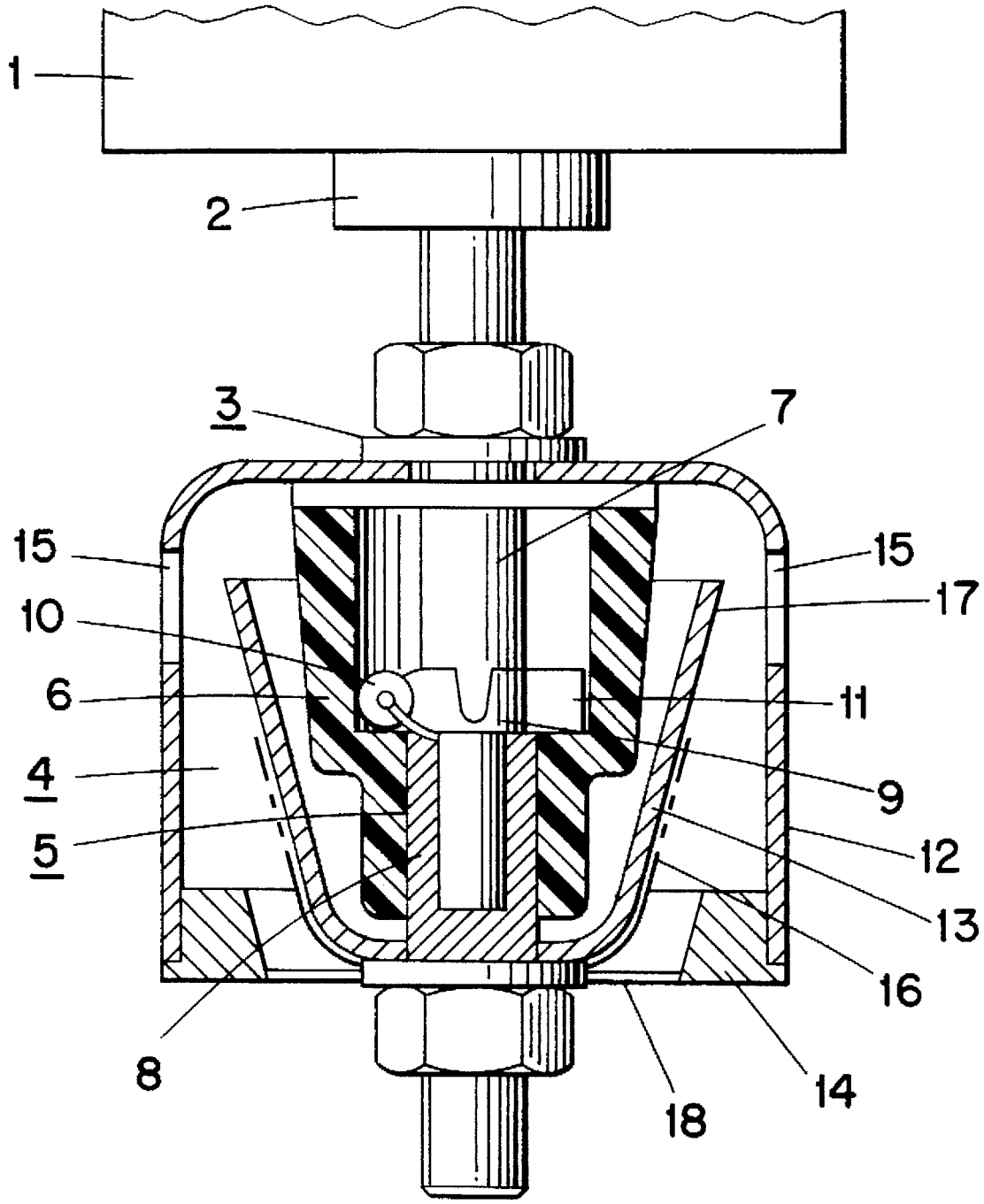
FIG. 1 shows a plan view of an axially routed section through an indicating device, which is designed to be essentially cylindrically symmetrical and is installed in an electrical connection of a surge arrester, according to invention before responding as a consequence of a fault current.
Figure 2:
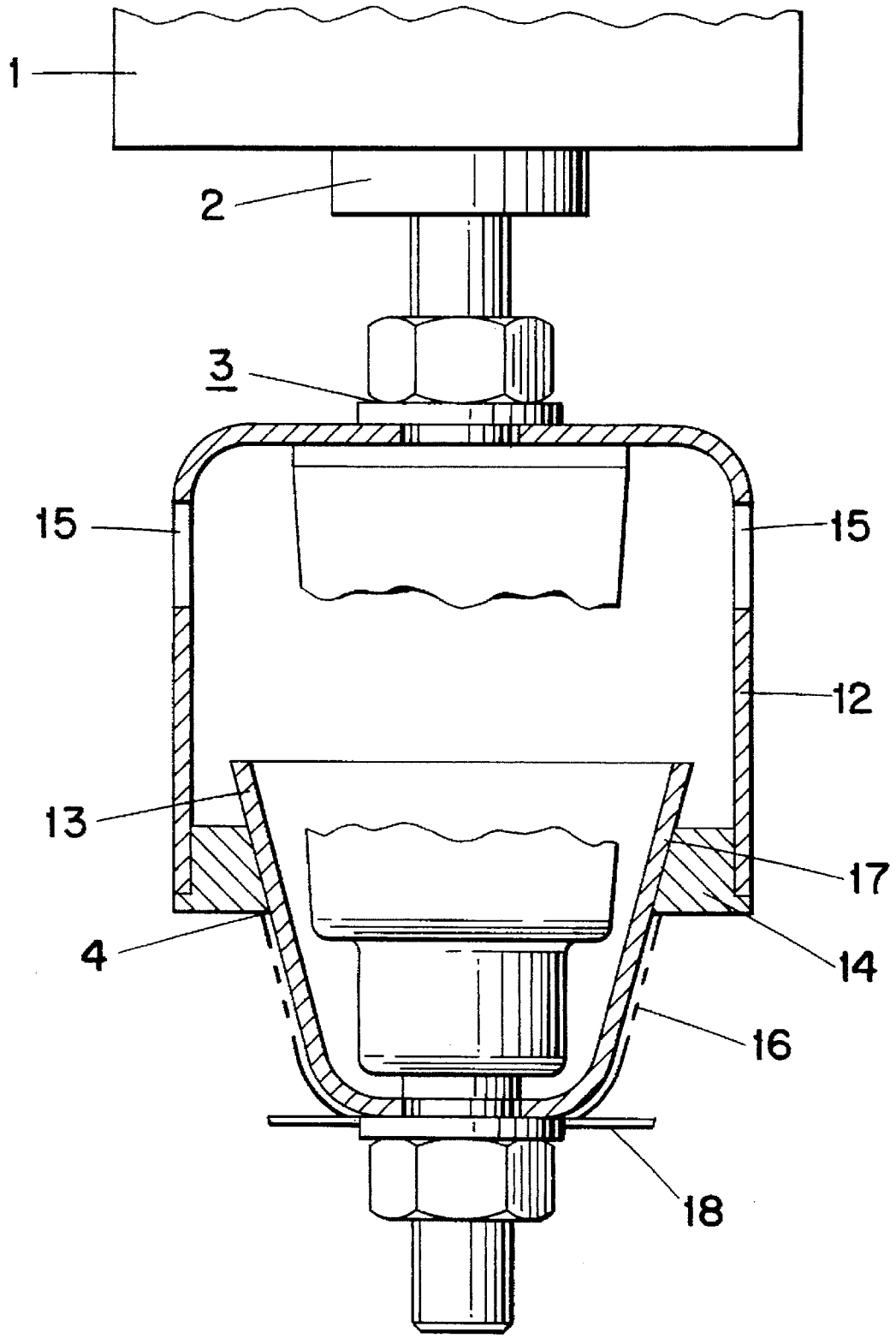
FIG. 2 shows the indicating device according to FIG. 1 after responding.

In FIGS. 1 and 2, 1 designates an electrical apparatus which is designed as a surge arrester and has a live part 2, which acts as an electrical connection and is connected in an electrically conductive manner to a device 3 for indicating a faulty condition of the surge arrester 1. The indicating device has a two-piece metal housing 4 made of a material which conducts electrical current well, such as aluminium or an aluminium alloy for example, which housing is attached to a switching element 5 of the indicating device 3.

The switching element 5 contains an insulating material housing 6 which is cylindrically symmetrical, is of gas-tight design and is made of a brittle material, such as a highly filled polymer, based on an epoxy, and two electrodes 7, 8 which are cylindrically symmetrical, are guided into the insulating material housing and are in each case held at one of the ends of the insulating material housing 6. The two electrodes 7, 8 are arranged one above the other on the axis of the insulating material housing 6 and, at mutually facing free ends, of which that of the electrode 7 is designed as a tip, form a spark gap 9 which is located in the insulating material housing 6. The mutually facing end sections of the electrodes 7, 8 are connected to the electrical connections of a resistor 10 which is connected in parallel with the spark gap 9 and is preferably designed as a fuse or PTC thermistor. The resistor 10 is dimensioned in such a manner that it can carry a high-current surge value which is still held by the surge arrester 1, for example of 100 kA for 4/10 μs, and such that, if it is loaded for more than a predetermined time period of, for example, 0.1 ms with a current which is above a predetermined limit value, of for example 20A, its electrical conductivity reduces suddenly, for example by melting or by means of a PTC transition. An explosive charge 11 is fitted in the interior of the insulating material housing 6, close to the spark gap 9, the quantity of which explosive charge 11 is dimensioned such that, when the charge detonates, the insulating material housing 6 can be made to spring apart into at least two parts which are moved away from one another and each hold one of the two electrodes 7, 8.

The metal housing 4 is formed by two shells 12, 13 which have different diameters and are each held by their bases at opposite ends of the switching element 5. The shell 12, which has the larger diameter, accommodates the shell 13, which has the smaller diameter. The shell 12 has an opening in its base, through which opening one connection of the electrode 7 is passed, which connection is connected in DC terms to the live part 2 of the surge arrester and has an external thread. The shell 12 is firmly connected, by means of a nut which is not shown, to the upper end of the switching element 5. The shell 12 is fitted on its edge with at least one contact element 14 which is directed into the shell interior, is designed in an annular shape and has an inner cone. This contact element 14 is provided with an internal thread which interacts with an external thread on the shell 12. Furthermore, the shell 12 has blow-out openings 15 for compressed gas. These blow-out openings can be provided with a filter which holds back solid particles in the housing interior, and they may be designed such that compressed gas which emerges is routed in a predetermined direction.

The shell 13 likewise has an opening it its base, through which opening one connection of the electrode 8 is passed, which connection has an external thread and is connected to earth potential. The shell 13 is firmly connected, by means of a nut which is not shown, to the lower end of the switching element 5. The shell 13 is fitted on its outside, which is covered by the shell 12, with an indicating element 16 which is designed, for example, as a paint coating. The shell 13 is expanded like a cone and is designed on its outside in the region of the shell edge as an electrical contact element 17 which is matched to the inner cone of the annular contact element 14. The interior of the metal housing 4 is closed by a cover 18, which is guided by the base of the shell 13 on the edge of the shell 12.

The method of operation of the indicating device 3 is, then, as follows: under normal operating conditions, the surge arrester 1 carries only a small leakage current, which is typically in the mA range. This leakage current flows from the live part 2 to earth, via the electrode 7, the resistor 10, the electrode 8 and a flexible conductor section which is connected in DC terms to this electrode 8 by means of a screw connection and is not illustrated. Current surges which are guaranteed by the surge arrester 1, for example up to 100 kA for 4/10 μs and flow through the arrester as a result of overvoltages, are dissipated in an appropriate manner to earth without the indicating device 3 responding.

If the surge arrester 1 or, in a corresponding manner, another electrical apparatus, for example an insulator of a switch or of a transformer, or an insulator of a high-voltage installation, has a defect, then a fault current in the A range or even kA range flows through the non-reactive resistor 10, which acts as a current sensor. The resistor 10 is severely heated and changes to a high-impedance state within a few ms, for example by melting or by means of PTC transition. The fault current then commutates into a current path containing the spark gap 9, with an arc being formed. The explosive charge 11, which is arranged in the region of the spark gap 9, is detonated by the arc which is formed. The compressed gas formed in this case decomposes the brittle insulating material housing 6 suddenly and then drives the electrode 8 and the shell 13, which is rigidly connected to it, downwards until the condition of the indicating device 3 illustrated in FIG. 2 is reached. The compressed gas is ejected through the blow-out openings from the interior of the metal housing 4, which is surrounded by the shells 12 and 13. Fragments which are produced during the destruction of the insulating material housing 6 are held back in the housing interior by the metal housing 4.

In the condition illustrated in FIG. 2, the conical expansion of the shell 13, which expansion is designed as a contact element 17, and the contact element 14, which is designed in annular form, of the stationary shell 12 have jammed. The fault current is no longer carried via the spark gap 9 of the switching element 5, but is now dissipated to earth via the shell 12 which is connected in DC terms to the electrode 7, the contact elements 14 and 17 which make contact with one another, and the shell 13 which is connected in DC terms to the electrode 8. That section of the shell 12 which is fitted with the indicating element 14 has now become visible and indicates the defective surge arrester to an observer.

The defective surge arrester 1 and the indicating device 3 can then be removed and replaced by new equipment.

The indicating device 3 can be made ready for operation again in a particularly cost-effective manner by installing a new switching element 5. After unscrewing the contact element 14 and releasing the two nuts, which are not shown in the figures, all that is necessary is to remove the two electrodes 7 and 8, and the new switching element 5 then just has to be inserted and screwed up.

LIST OF REFERENCE NUMERALS

1 Surge arrester
2 Live part
3 Indicating device
4 Metal housing
5 Switching element
6 Insulating material housing
7,8 Electrodes
9 Spark gap
10 Resistor
11 Explosive charge
12,13 Shells
14 Contact element
15 Blow-out openings
16 Indicating element
17 Contact element
18 Cover

I claim:

1. Device for indicating a faulty condition of an electrical apparatus, in particular of a surge arrester (1), having a sensor for detecting a fault current flowing through the apparatus, a gas-tight insulating material housing (6) which accommodates the sensor, and an indicating element (16), characterized in that the insulating material housing (6) is surrounded by a two-piece metal housing (4) to which the indicating element (16) is fitted, and in that the sensor and the insulating material housing (6) are part of a switching element which displaces the two parts of the metal housing (4) with respect to one another, by the formation of compressed gas, when the fault current occurs, making the indicating element (16) visible and forming a DC connection which carries the fault current.

2. Indicating device according to claim 1, characterized in that the metal housing (4) is formed by two shells (12, 13) which have different diameters and are each held by their bases at opposite ends of the switching element (5), a first shell (12), which has the larger diameter, accommodating a second shell (13), which has the smaller diameter and is fitted with the indicating element (16) on its outside.

3. Indicating device according to claim 2, characterized in that the second shell (13) is expanded like a cone, and in that the first shell (12) is fitted on its edge with at least one contact element (14) which is directed into the shell interior and makes contact with the cone-like expansion of the second shell (13) when the two shells (12, 13) are displaced, while maintaining the DC connection.

4. Indicating device according to claim 3, characterized in that the at least one contact element (14) is designed in an annular shape and has an inner cone which is matched to the cone-like expansion of the second shell (13).

5. Indicating device according to claims 2, characterized in that the interior of the metal housing (5) is closed by a cover (18) which is guided by the base of the second shell (13) on the edge of the first shell (12).

6. Indicating device according to claim 2, characterized in that at least one (12) of the two shells (12, 13) has blow-out openings (15) for the compressed gas which is formed.

7. Indicating device according to claim 1, characterized in that a spark gap (9), which is electrically conductively connected to a live part (2) of the apparatus, and an explosive charge (11) are provided in the insulating material housing (6) of the switching element (5).

8. Indicating device according to claim 7, characterized in that a non-reactive resistor (10), which is arranged in parallel with the spark gap (9), is provided as the sensor.

9. Indicating device according to claim 7, characterized in that the two electrodes (7, 8) of the spark gap (9) are held by the insulating material housing (6) of the switching element (5) and are each fitted with one of the two shells (12, 13) in an electrically conductive manner.

10. Indicating device according to claim 9, characterized in that the insulating material housing (6) is made of brittle material and, when the compressed gas is formed, can spring apart into at least two parts which are moved away from one another and each hold one of the two electrodes (7,8).

* * * * *